United States Patent [19]

Fuchizawa

[11] Patent Number: 4,599,288

[45] Date of Patent: Jul. 8, 1986

[54] ELECTROPHOTOGRAPHIC PLATE-MAKING MATERIAL

[75] Inventor: Tetsuro Fuchizawa, Shizuoka, Japan

[73] Assignee: Fuji Photo Film Co., Ltd., Kanagawa, Japan

[21] Appl. No.: 590,669

[22] Filed: Mar. 19, 1984

[30] Foreign Application Priority Data

Mar. 18, 1983 [JP] Japan ..... 58-45514

[51] Int. Cl.[4] ..... G03G 5/14

[52] U.S. Cl. ..... 430/63; 430/65; 430/49; 430/942

[58] Field of Search ..... 430/49, 62, 63, 64, 430/65, 69, 942

[56] References Cited

U.S. PATENT DOCUMENTS 4,011,080 3/1977 McCabe ..... 430/62

4,014,695 3/1977 Buckley et al. ..... 430/64 X 4,148,639 4/1979 Sinkovitz et al. ..... 430/62

4,416,963 11/1983 Takimoto et al. ..... 430/63 X 4,456,670 6/1984 Nakayama et al. ..... 430/63 X

FOREIGN PATENT DOCUMENTS 757393 3/1971 Belgium ..... 430/63

44-14035 6/1969 Japan ..... 430/69

*Primary Examiner*—Roland E. Martin

*Attorney, Agent, or Firm*—Sughrue, Mion, Zinn, Macpeak & Seas

[57] ABSTRACT

An electrophotographic plate-making material comprising a support with a volume resistance of $10^{10}\Omega$ or less which support comprises at least one resin layer hardened by electron beam irradiation and a base paper, which support has a photoconductive layer on the resin layer.

17 Claims, No Drawings

ELECTROPHOTOGRAPHIC PLATE-MAKING MATERIAL

FIELD OF THE INVENTION

The present invention relates to an electrophotographic plate-making material from which a lithographic printing plate can be made by an electrophotographic method, and particularly relates to an electrophotographic plate-making material which yields a lithographic printing plate with a long press life, using a support which comprises a base paper.

BACKGROUND OF THE INVENTION

A method for preparing a lithographic printing plate by an electrophotographic method is known. In general, the lithographic printing plate is prepared by the successive steps of uniform charging of a photoconductive layer of an electrophotographic plate-making material, obtaining a toner image by a wet or dry development after imagewise exposure, and making non-image areas which are free of toner hydrophilic by a treatment with a desensitizing solution (etching liquid) after the toner image is fixed.

As such electrophotographic plate-making materials, ones comprising a paper support are known. However, lithographic printing plates obtained from such materials possess a press life of only around 3,000 sheets. The main reason for this short press life is permeation of water into the paper support. Specifically, permeation of etching liquid (which is an aqueous solution) used in the desensitizing process at non-image areas after plate-making and permeation of dampening water used during printing occur to cause stretching of the paper support due to water absorption. In an extreme case, exfoliation between the paper support and the photoconductive layer occurs.

With respect to print quality, for example, about 100 lines/inch is the limit of dots reproducebility.

Further, the water content of the support varies according to the temperature and humidity conditions at exposure; as a result, conductivity changes, which affects electrophotographic performance.

Various proposals have been made to overcome the above problems. One employs an intermediate layer between the base paper and the photoconductive layer. For example, the following have been proposed: the use of an intermediate epoxy resin layer in Japanese Patent Application (OPI) No. 138904/75 (the term "OPI" as used herein refers to a "published unexamined Japanese Patent Application"); the use of an intermediate ethylene derivative layer such as an ethylene-acrylic acid copolymer, ethylene-methacrylic acid copolymer, ethylene-vinyl acetate copolymer, ethylene-vinyl acetate-vinyl chloride copolymer, ethylene ionomer and the like in Japanese Patent Application (OPI) No. 105580/80; the use of an intermediate layer formed by coating with an aqueous polyethylene emulsion mixed with carbon black or graphite and drying in Japanese Patent Application (OPI) No. 14804/79.

However, the use of electrophotographic plate-making materials having the above intermediate layers still does not provide a lithographic printing plate with a long press life.

SUMMARY OF THE INVENTION

Therefore, the objects of the present invention are: firstly, to provide an electrophotographic plate-making material which yields a lithographic printing plate with good dimensional stability and long press life; secondly, to provide an electrophotographic plate-making material which exhibits little change in photographic performance under different temperature and humidity conditions; thirdly, to provide an electrophotographic plate-making material having excellent handling capability, especially one which is for use in an automatic plate-making machine.

As a result of intensive research, the inventors found that the above objects could be achieved by an electrophotographic plate-making material which comprises a support with a volume resistance of not more than $10^{10}\Omega$, comprising a base paper having a resin layer hardened by electron beam irradiation on at least one surface thereof, and a photoconductive layer on the above resin layer.

As used herein, the term "support" includes the base paper which carries thereon at least one resin layer hardened by electron beam irradiation, the support having the defined volume resistance.

DESCRIPTION OF PREFERRED EMBODIMENTS

The resin layer hardened by electron beam irradiation can be obtained by placing a known compound or composition hardenable by electron beam irradiation on at least one face of the base paper in layer form and irradiating all of the layer with electron beams. Various compounds are known to be hardenable by electron beam irradiation. Most preferred compounds in this invention are those having unsaturated bond(s) polymerizable by the action of electron beams. Examples include those having at least one vinyl or vinylidene carbon-carbon double bond, preferably two or more vinyl or vinylidene carbon-carbon double bonds, more preferably 2 to 4 bonds, such as compounds containing an acryloyl group, acrylamide group, allyl group, vinyl ether group, vinyl thioether group, etc., unsaturated polyester compounds, etc.

As the above compounds having unsaturated bonds, most preferred compounds are polymer or oligomer having acryloyl and/or methacryloyl groups at both ends of a straight chain, as are described in A. Vrancken "Fatipec Congress", 11 19 (1972). One example is shown below:

$$CH_2{=}CH{-}CO_2{-}CH_2\underset{\underset{OH}{|}}{C}HCHO\left(COCH_2CH_2CO_2CH_2\underset{\underset{OH}{|}}{C}HCH_2O\right)_n COCH_2{=}CH_2$$

The polyester skeleton of the exemplified compound can be replaced by a polyurethane skeleton, an epoxy resin skeleton, a polyether skeleton, a polycarbonate skeleton or a skeleton comprising two or more of the above skeletons. One end or both ends of the exemplified compounds can be replaced by methacryloyl group, if desired. Weight average molecular weight is preferably in the range of ca. 500 to 20,000.

Among these compounds, Aronix M6100 and M7100 made by Toagosei Chemical Industry Co., Ltd. and the like are commercially available.

Furthermore, monomers having unsaturated carbon-carbon bonds and/or organic solvents can be used in addition to these compounds. Examples of such monomers include acrylic acid; methacrylic acid; itaconic acid; acrylic acid alkyl esters and homologs thereof, e.g., methyl acrylate; methacrylic acid alkyl esters and homologs thereof, e.g., methyl methacrylate; styrene and homologs thereof, e.g., α-methylstyrene, β-chlorostyrene, etc.; acrylonitrile; methacrylonitrile; acrylamide; methacrylamide; vinyl acetate; vinyl propionate and the like. Two or more unsaturated bonds can also be present in the same molecule. Examples of such compound are described in "Data Book of Photosensitive Resins" published by Sogo Kagaku Kenkyusho, Inc., December 1968, pp. 235–236. Particularly, the following are preferred: unsaturated esters of polyols such as ethylene glycol diacrylate, butoxyethyl acrylate, 1,4-butanediol diacrylate, 1,6-hexanediol acrylate, stearyl acrylate, 2-ethylhexyl acrylate, diethylene glycol diacrylate, diethylene glycol dimethacrylate, tetraethylene glycol diacrylate, glycerol trimethacrylate, trimethylol propane triacrylate, pentaerythritol triacrylate, ethylene glycol dimethacrylate, pentaerythritol tetramethacrylate, etc., and glycidyl methacrylate which is a monomer containing an epoxy ring, etc. Compounds having one unsaturated bond and those having two or more unsaturated bonds can be used in combination.

In the case of the addition of a monomer, the monomer is added preferably in an amount of 80% by weight or less based on the total amount of polymer and/or oligomer and the monomer. Below this value, high levels of energy are required for hardening.

Furthermore, the following thermoplastic resins can be added on preparation if coating solution alone or in combination to the compound or composition used in this invention which is hardenable by electron beam irradiation, if desired: vinyl chloride-vinyl acetate copolymers, cellulose resins, acetal resins, vinyl chloride-vinylidene chloride resins, urethane resins, acrylonitrile-butadiene resins, etc.

These compounds or compositions being hardenable by electron beam irradiation are blended with an electrically conductive substance so that the final volume (electric) resistance of the support is not more than $10^{10}\Omega$. Volume electric resistance (Rv) is calculated according to the following equation, where the electric current value A is determined by putting a sample between two metallic circular electrodes with a radius of 2.5 cm and a loading direct current of voltage V.

$$\text{Volume electric resistance } R_v = \frac{V}{A}\ (\Omega)$$

This addition of the electrically conductive substance suppresses changes in photographic performance with humidity changes (especially at low humidity) and insures a lithographic printing plate with excellent picture quality and long press life. Preferred electrically conductive substances are the metal oxides described in French Pat. No. 2,277,136 and U.S. Pat. No. 3,597,272, and especially preferred are the following: oxides of metals selected from zinc, magnesium, tin, barium, indium, molybdenum, aluminium, titanium, silicon, fine particles of crystalline oxide or complex oxides, or carbon black. Electrically conductive carbon black is most preferred because of its low cost and ease of mixing with the compounds or compositions to be hardened by electron beam irradiation.

These electrically conductive substances are used in an amount such that the volume resistance is not more than $10^{10}\Omega$, more favorably not more than $10^{8}\Omega$. Though the amount used to obtain such a resistance value varies with the kind of base paper, the layer to be hardened by electron beam irradiation and, electrically conductive substance, in general the amount is in the range of 5–30 wt% based on the compound or composition to be hardened by electron beam irradiation.

The base paper can be coated with the above compound or composition to be hardened by electron beam irradiation when it is liquid. In the case of a viscous liquid or solid, an organic solvent is added. The following are examples of generally used organic solvents: ketones such as acetone, methyl ethyl ketone, methyl isobutyl ketone, cyclohexanone, etc.; esters such as methyl acetate, ethyl acetate, butyl acetate, ethyl lactate, monoethyl ether of glycol acetate, etc.; glycol ethers such as ether, glycol dimethyl ether, glycol monoethyl ether, dioxane, etc.; aromatic hydrocarbons such as benzene, toluene, xylene, etc.; chlorinated hydrocarbons such as methylene chloride, ethylene chloride, carbon tetrachloride, chloroform, 2-chloroethyl alcohol, dichlorobenzene, and the like.

The composition to be hardened by electron beam irradiation composed of the above-mentioned ingredients is generally kneaded. Each ingredient can be simultaneously or sequentially added to the kneading machine. A conventional dispersing agent can be added with the electrically conductive substance, if desired.

Various conventional kneading machines can be employed to knead and disperse the compositions. Examples include a two-roll mill, three-roll mill, ball mill, pebble mill, trommel, sand grinder, Szegvari attriter, high speed impeller dispersing machine, high speed stone mill, high speed impact mill, kneader, high speed mixer, homogenizer, ultrasonic dispersing machine, etc.

Techniques of kneading and dispersing are described in "Paint Flow and Pigment Dispersion" (1964, published by John Wiley & Sons Co.) written by T. C. Patton, as well as in U.S. Pat. Nos. 2,581,414 and 2,855,156.

The following are typical methods for coating the support with the afore-mentioned composition: air doctor coating, blade coating, air knife coating, squeeze coating, impregnation coating, reverse roll coating, transfer roll coating, gravure coating, kiss coating, cast coating, spray coating, spin coating, etc. Other methods can also be employed. Disclosure thereon occurs at pages 253–277 of "Coating Technology" published by Asakura Shoten on Mar. 20, 1971.

The dry thickness of the coated layer is preferably in the range of 5 to 50μ. In the case of a thickness below 5μ, resistance to water is insufficient. On the other hand, when the thickness exceeds 50μ, the performance is not improved but substantial energy is required for hardening, which results in increased cost. Therefore, the preferred thickness is in the range of 10 to 30μ. Such a coated layer is formed on at least one face of the base paper, more preferably on both faces thereof.

A conventional method, double scanning method or a curtain beam method of the Van de Graaf type can be used as the electron beam exposure means. Preferred is the curtain beam method which is relatively unexpensive and provides a high output. With respect to electron beam characteristics, the acceleration voltage is typically in the range of 100 to 1000 KV, more preferably 100 to 300 KV, and the absorption dose ranges from 0.5 to 20 megarads, more preferably from 2 to 10 megarads. Electron beam within these ranges exerts successful hardening. Energy transmittance is not sufficient at an acceleration voltage less than 100 KV, while the use of an acceleration voltage of above 1000 KV is not economical because energy efficiency for polymerization decreases. The hardening reaction is insufficient and a material of the desired quality is not obtained at an absorption dose of less than 0.5 megarad, while it is not preferred to dose at more than 20 megarads due to decreased energy efficiency and the generation of heat in the irradiated material.

If desired, surface smoothing by means of a glass face roll or surface matting by means of a mat roll can be applied after coating or hardening.

In order to control the adhesion between base paper and the resin layer hardened with electron beams, the surface of the base paper can be treated with a conventional corona discharge or can be coated with polyethylene derivatives such as an ethylene-vinyl acetate copolymer, ethylene-acrylic acid ester copolymer, ethylene-methacrylic acid ester copolymer, ethylene-acrylic acid copolymer, ethylene-methacrylic acid copolymer, ethylene-acrylonitrile-acrylic acid copolymer, ethylene-acrylonitrile-methacrylic acid copolymer and the like. Further, the surface treating methods described in the following publications can be applied to the base paper: Japanese Patent Application (OPI) Nos. 24126/74, 36176/77, 121683/77, 2612/78, 111331/79 and Japanese Patent Publication No. 25337/76.

Alternatively, any electrically conductive base paper heretofore used for electrophotosensitive materials can be used as the base paper of this invention. For example, the following can be used: paper impregnated with an ionically conducting substance, inorganometallic compounds as described in U.S. Pat. No. 3,597,272 and French Pat. No. 2,277,136, electrically conductive substances such as carbon black, etc.; the paper can be mixed with the above substances at paper making, if desired; synthetic paper as described in Japanese Patent Publication Nos. 4239/77, 19031/78 and 19684/78 can also be used.

The photoconductive layer which is formed on the above-mentioned support comprises a photoconductive substance and a binder. The following are examples of the photoconductive substance: inorganic photoconductive substances such as zinc oxide, cadmium sulfide, titanium oxide, etc., and organic photoconductive substances such as phthalocyanine dyestuffs, etc. The following are examples of the binder: silicone resins, polystyrene, polyacrylic or methacrylic acid esters, polyvinyl acetate, polyvinyl chloride, polyvinyl butyral and derivatives thereof.

It is generally appropriate to use the photoconductive substance and the binder at a weight ratio of 3:1 to 20:1. If desired or necessary, a sensitizer or coating auxiliary agent which is used at coating can be added.

The photoconductive layer is formed on the resin layer of the above-mentioned support which has been hardened with electron beams. It is preferred to pretreat the surface of the resin layer to be hardened with electron beams by a corona discharge treatment, glow discharge treatment, flame treatment, UV treatment, ozone treatment, plasma treatment, etc., as described in U.S. Pat. No. 3,411,908, because of improved adhesion to the photoconductive layer. The thickness of the above photoconductive layer is generally in the range of 5 to 30$\mu$.

In a particularly preferred embodiment of this invention, an intermediate layer containing colloidal silica and/or alumina is formed between the resin layer of afore-mentioned support hardened with electron beams and the above-mentioned photoconductive layer. This intermediate layer is formed by dissolving a resin used as a binder for colloidal alumina and/or silica in water or, in some cases, an organic solvent, adding colloidal alumina and silica as a powder or dispersion, mixing using conventional means such as propeller mixing or ultrasonic dispersion and coating the resin layer with the resulting dispersion. Colloidal silica and colloidal alumina of a grain diameter of 1 to 100 m$\mu$ are generally used and are available as aqueous dispersions. According to the contemplated use, they are also available as materials having good compatibility to organic solvent. Therefore, it is not necessary to limit the resin which can be used as the intermediate layer. Examples of the resin include polyethylene terephthalate, polyimide, polycarbonate, polyacrylate, polymethyl methacrylate, polyvinyl fluoride, polyvinyl chloride, polyvinyl acetate, polystyrene, styrenebutadiene copolymers, polymethacrylate, silicone resins, chlorinated gums, epoxy resins, pure and modified alkyd resins, polyethyl methacrylate, poly-n-butyl methacrylate, cellulose acetate, ketone resins, polyethylene, polypropylene, polyacrylonitrile, rosin derivatives, polyvinylidene chloride, nitrocellulose, phenol-formaldehyde resins, cresol-formaldehyde resins, styrene-maleic anhydride copolymers, polyacrylic acid-polyacrylamide copolymers, fumaric acid-ethylene glycol copolymers, methyl vinyl ether-maleic anhydride copolymers, acryloylglycine-vinyl acetate copolymers, polyvinylpyrrolidone, polyvinyl alcohol, polyamide, halogenated styrenes, etc. The coating amount of the intermediate layer is generally in the range of 0.01 to 10 g/m$^2$.

Heretofore known methods can be employed for the preparation of a lithographic printing plate using the electrophotographic plate-making material of this invention. More specifically, the photoconductive layer is uniformly charged by corona charging, etc., and a charged image area is formed by the imagewise exposure. Toner is then bonded to the charged image area by a wet or dry process and the toner image is fixed by heating, etc. Thereafter, non-image areas free from bonded toner are rendered hydrophilic by treating them with desensitizing solution. As desensitizing solution, for example, compositions containing ferrocyan compounds or ferricyan compounds as described in U.S. Pat. No. 4,116,698 and compositions containing metal complexes as described in U.S. Pat. No. 4,282,811 can be used. At least 10,000 sheets of printed matter of excellent print quality can be prepared by conventional offset printing using the thus formed lithographic printing plate.

In the present invention, dimensional stability is superior to known electrophotographic plate-making materials due to the high water-repellency of the resin layer hardened by electron beam irradiation.

An electrophotosensitive material comprising an aluminum foil and polyethylene layer between a base paper and a photoconductive layer is disclosed in Japanese Patent Application (OPI) No. 28241/73. In the present invention, however, the resin layer hardened by electron beam irradiation contains an electrically conductive substance and, therefore, the volume electrical resistance of the total support does not exceed $10^{10}\Omega$. From this reason, it is not necessary to provide an electrically conductive layer as a separate layer, which simplifies production. Further, there is observed no cracking as may occur in the presence of an aluminum foil.

The performance characteristics of the electrophotographic plate-making material of this invention include highly improved printing durability which enables one to print at least 10,000 sheets. Sensitivity changes due to atmospheric conditions at exposure are so small that excellent image quality is obtained. For example, half tone image of 133 lines/inch can be reproduced by a wet developing method. It also has an excellent fitness for use in an automatic plate-making machine, and, therefore, the plate handling by conveyor roller goes smoothly in the successive treatments of exposure, development, fixing and desensitization, using an automatic plate-making machine.

The present invention will be explained in detail by the Examples below. "%" and "parts" mean weight % and weight parts respectively, unless otherwise indicated.

EXAMPLE 1

An electro-conductive base paper was obtained by coating a high quality paper of a square weight of 100 g/m$^2$ with 20 g/m$^2$ of a 5% aqueous solution of polyvinylbenzyltrimethylammonium chloride and drying. After the following composition had been stirred for 20 hours in a ball mill, both faces of this base paper were coated with the resulting composition in such an amount that the dry thickness was 25$\mu$. The resulting material was then dried.

Electrically conductive carbon: 7 parts
Acrylate oligomer of urethanes (described in Example 1 of U.S. Pat. No. 4,092,173): 12 parts
Diethylene glycol diacrylate: 9 parts
Methyl methacrylate: 9 parts
Acetone: 60 parts The above material was then irradiated with electron beams at a 200 KV acceleration voltage until the absorption dose was 3 megarads. The volume electric resistance of the support was $10^8\Omega$. Next, the surface of the polymer layer on one face of the support was subjected to corona discharge at 5 KVAsec/m$^2$. The resulting support was then coated with a coating liquid consisting of the following ingredients in such an amount the the coated amount after wire bar coating and drying was 1 g/m$^2$. An intermediate layer was thus formed.

Colloidal alumina (15% aq. solution): 50 parts
Colloidal silica (20% aq. solution): 20 parts
Polyvinyl acetate emulsion (Cebian A made by DAICEL Ltd.): 150 parts
Surfactant (Amisole CDC made by Kawaken Fine Chemicals Co., Ltd.): 0.1 part
Water: 100 parts Finally, an electrophotographic plate-making material of this invention was obtained by preparing a photoconductive layer by coating the above layer with a coating liquid consisting of the following ingredient in such an amount that the coated amount after drying was 20 g/m$^2$, followed by drying.

Photo conductive zinc oxide (Sazex 2000 made by Sakai Chemical Industry Co., Ltd.): 100 parts
Silicone resin (KR-211 made by Shin-Etsu Chemical Co., Ltd.): 35 parts
Rose bengal: 0.1 part
Fluorescein: 0.2 part
Methanol: 10 parts
Toluene: 150 parts The thus obtained electrophotographic plate-making material was allowed to stand in the dark at 25° C., 45% RH for 12 hours, and then a lithographic printing plate was made from the material using plate-making machine of Itek 135 type (made by Itek Co.). The resulting plate was then treated with an etching liquid (made by Addressograph Multigraph Co.) for desensitization. Using the resulting plate, printing by an offset printer of Hamada Star 700 afforded at least 10,000 sheets of printed matter of an excellent print quality which reproduced a half tone image of 133 lines/inch.

EXAMPLE 2

After both faces of the electrically conductive paper used in Example 1 had been subjected to a corona discharge treatment at 5 KVAsec/m$^2$, a resin layer hardened by electron beams was prepared to yield a support using similar treatments as described in Example 1. The volume resistance of this support was ca. $10^8\Omega$. Then, an electrophotographic plate-making material of this invention was obtained by corona discharge treating one face thereof, then forming an intermediate layer and a photoconductive layer in a manner similar to Example 1. Using this material, offset printing with thus obtained lithographic printing plate obtained by a plate-making treatment in a manner similar to Example 1 provided 10,000 sheets of printed matter of good quality.

While the invention has been described in detail and with reference to specific embodiments thereof, it will be apparent to one skilled in the art that various changes and modifications can be made therein without departing from the spirit and scope thereof.

What is claimed is:

1. An electrophotographic plate making material, comprising:

a support with a volume resistance of $10^{10}\Omega$ or less which support comprises at least one resin overlayer prepared from a compound or a composition containing at least one compound with at least one unsaturated bond polymerizable by electron beam irradiation which has a thickness in the range of 5–50$\mu$ and is hardened and polymerized by electron beam irradiation with an electron beam with an acceleration voltage in the range of 100–1,000 KV and an absorption dose in the range of 0.5 to 20 megarads and a base paper, which resin layer contains electrically conductive substances selected from the group consisting of oxides of metals selected from zinc, magnesium, tin, barium, indium, molybdenum, aluminum, titanium, silicon, fine particles of crystalline oxide or complex oxides, or carbon black in an amount in the range of 5–30 wt% based on the weight of the compound or composition to be hardened and polymerized by electron beam irradiation, and wherein a photoconductive layer is present on the resin layer.

2. An electrophotographic plate-making material as claimed in claim 1, wherein the compound is a compound having at least one vinyl or vinylidene carbon-carbon double bond.

3. An electrophotographic plate-making material as claimed in claim 1, wherein the compound is a compound containing at least one group selected from the groups consisting of an acryloyl group, acrylamide group, allyl group, vinyl ether group, vinyl thioether group or an unsaturated polyester compound.

4. An electrophotographic plate-making material as claimed in claim 1, wherein the compound is a polymer or oligomer having acryloyl group, methacryloyl group or both of them at one end or both ends.

5. An electrophotographic plate-making material as claimed in claim 1, wherein the volume resistance of the support is $10^8\Omega$ or less.

6. An electrophotographic plate-making material as claimed in claim 1, wherein an intermediate layer containing a colloidal silica, a colloidal alumina or both of them is present between the resin layer and the photoconductive layer.

7. An electrophotographic plate-making material as claimed in claim 1, wherein said resin layer is prepared from at least one monomer selected from the group consisting of acrylic acid, methacrylic acid, itaconic acid, acrylate, methacrylate, styrene, acrylonitrile, methacrylonitrile, acrylamide, methacrylamide, vinyl acetate and vinyl propionate.

8. An electrophotographic plate-making material as claimed in claim 1, wherein the photoconductive layer comprises a photoconductive material and a binder, the photoconductive material being an inorganic photoconductive material or an organic photoconductive material.

9. An electrophotographic plate-making material as claimed in claim 1, wherein said resin layer has a thickness in the range of 10–30$\mu$.

10. An electrophotographic plate-making material as claimed in claim 2, wherein said compound has at least two vinyl or vinylidene carbon-carbon double bonds.

11. An electrophotographic plate-making material as claimed in claim 10, wherein the compound is a compound having 2 to 4 vinyl or vinylidene carbon-carbon double bonds.

12. An electrophotographic plate-making material as claimed in claim 4, wherein the resin layer is prepared from at least one monomer selected from the group consisting of acrylic acid, methacrylic acid, itaconic acid, acrylate, methacrylate, styrene, acrylonitrile, methacrylonitrile, acrylamide, methacrylamide, vinyl acetate, and vinyl propionate added in an amount of 80% by weight or less based on the total amount of polymer and/or oligomer and the monomer.

13. An electrophotographic plate-making material as claimed in claim 1, wherein said acceleration voltage is in the range of 100–300 KV.

14. An electrophotographic plate-making material as claimed in claim 1, wherein the absorption dose ranges from 2–10 megarads.

15. An electrophotographic plate-making material as claimed in claim 1, wherein said photoconductive layer is formed on said support and comprises a photoconductive substance and a binder at a weight ratio of 3:1 to 20:1.

16. An electrophotographic plate-making material as claimed in claim 1, wherein the thickness of said photoconductive layer is in the range of 5–30$\mu$.

17. An electrophotographic plate-making material as claimed in claim 6, wherein the coating amount of the intermediate layer is in the range of 0.01 to 10 g/m$^2$.

* * * * *